US010532871B2

(12) United States Patent
Hightower

(10) Patent No.: US 10,532,871 B2
(45) Date of Patent: Jan. 14, 2020

(54) RIM CONCEALED COVER DISPOSABLE CONTAINER

(71) Applicant: Linda Tonia Hightower, Orlando, FL (US)

(72) Inventor: Linda Tonia Hightower, Orlando, FL (US)

( * ) Notice: Subject to any disclaimer, the term of this patent is extended or adjusted under 35 U.S.C. 154(b) by 124 days.

(21) Appl. No.: 15/726,491

(22) Filed: Oct. 6, 2017

(65) Prior Publication Data

US 2018/0099801 A1 Apr. 12, 2018

Related U.S. Application Data

(60) Provisional application No. 62/404,766, filed on Oct. 6, 2016.

(51) Int. Cl.
*B65D 77/20* (2006.01)
*A47G 19/02* (2006.01)
*B65B 7/16* (2006.01)

(52) U.S. Cl.
CPC ..... *B65D 77/2016* (2013.01); *A47G 19/02* (2013.01); *B65B 7/161* (2013.01)

(58) Field of Classification Search
CPC ..... B65D 77/2016; B65D 77/2012; B65D 77/2008; B65D 77/2004; B65D 77/20; B65D 77/2032; B65D 77/2028; B65D 77/2024; B65D 77/2056; B65D 65/04; B65D 65/02; B65D 65/10; B65D 65/14; B65D 51/20; A47G 19/02; B65B 7/161; B65B 7/16; B65B 11/06; B65F 1/062
USPC .... 220/574.3, 574, 212, 241, 287, 729, 730, 220/359.2, 359.1, 495.07, 495.03; 53/461, 465, 420, 478, 477, 476; 426/396, 392; 206/497, 816, 769, 770, 206/772, 564, 561, 565, 541, 542, 548; 229/406, 407, 902, 904
See application file for complete search history.

(56) References Cited

U.S. PATENT DOCUMENTS 1,637,100 A * 7/1927 Bothe ..... A21B 3/131 220/574
1,848,066 A * 3/1932 Shepard ..... A47G 19/02 220/575
2,287,495 A * 6/1942 Moyers ..... B65D 25/16 217/3 BC
2,731,997 A 1/1956 Muth et al.
3,097,782 A 7/1963 Koropatkin et al.
3,797,652 A * 3/1974 Chesky ..... B65D 21/0233 206/229
4,141,487 A 2/1979 Faust et al.
4,337,812 A 7/1982 Trinkner
4,530,440 A 7/1985 Leong
4,777,992 A 10/1988 Olger
4,851,632 A 7/1989 Kaliski
4,894,247 A 1/1990 Fong
4,911,938 A 3/1990 Fisher et al.
4,989,748 A 2/1991 Parr, Jr. et al.
(Continued)

*Primary Examiner* — Robert J Hicks
(74) *Attorney, Agent, or Firm* — The Roy Gross Law Firm, LLC; Roy Gross

(57) ABSTRACT

Disposable containers for storing contents, such as food products. The containers include a cover material disposed about a periphery or an outer surface of the container in a folded configuration and deployed, when pulled out by a user, in an amount and shape sufficient to cover at least the opened periphery of the container.

20 Claims, 6 Drawing Sheets

(56) References Cited

U.S. PATENT DOCUMENTS

| | | | | |
|---|---|---|---|---|
| 5,240,134 | A * | 8/1993 | McDermott | B65D 25/16 217/3 R |
| 5,240,330 | A | 8/1993 | Thompson | |
| 5,323,558 | A | 6/1994 | Baumler | |
| 5,672,406 | A | 9/1997 | Challis et al. | |
| 5,941,408 | A * | 8/1999 | Sherman | A45C 3/04 220/495.01 |
| 5,958,482 | A | 9/1999 | Monforton | |
| 5,971,611 | A | 10/1999 | Rosengren | |
| 6,384,391 | B1 | 5/2002 | Beckwith | |
| 7,494,701 | B2 | 2/2009 | Lin | |
| 8,051,510 | B2 | 11/2011 | Soloway | |
| 8,590,462 | B1 | 11/2013 | Dyson | |
| 8,746,481 | B2 | 6/2014 | Ferguson | |
| 8,858,858 | B2 | 10/2014 | Middleton et al. | |
| D740,590 | S | 10/2015 | Obrentz | |
| 9,630,748 | B2 * | 4/2017 | Keller | B65D 31/10 |
| 2006/0283857 | A1 | 12/2006 | Russell-Fleming et al. | |
| 2007/0062957 | A1 | 3/2007 | Kolleda | |
| 2007/0275130 | A1 | 11/2007 | Cole et al. | |
| 2009/0050624 | A1 | 2/2009 | Ventura | |
| 2011/0284566 | A1 | 11/2011 | Segal | |
| 2016/0066587 | A1 | 3/2016 | Trinh et al. | |

* cited by examiner

RIM CONCEALED COVER DISPOSABLE CONTAINER

CROSS REFERENCE TO RELATED APPLICATIONS

This application claims priority to U.S. Provisional Patent Application No. 62/404,766 entitled RIM CONCEALED COVER DISPOSABLE CONTAINER filed on Oct. 6, 2016. The contents of this application are incorporated by reference in their entirety.

FIELD OF THE INVENTION

The present invention relates, in some embodiments thereof, to containers and disposable containers for storing contents, such as food products. The containers comprise a cover material disposed about a periphery or an outer surface of the container in a folded configuration and deployed, when pulled out by a user, in an amount and shape sufficient to cover at least the opened periphery of the container.

BACKGROUND OF THE INVENTION

Numerous containers for storing beverages, foods and various other products are known. Nevertheless, there remains an unmet need for providing containers to that serve to eat or drink food or beverages, and also to provide for easy transport of food and beverages if the food or beverages are partially consumed.

In particular, there is a need for providing a self-contained container with a cover that allows for easy transport of food and beverage after the food or beverage is partially consumed.

It is an object of the present invention to achieve this unmet need.

SUMMARY OF THE INVENTION

Objects of the invention are achieved by providing a self-contained container with a cover that allows for easy transport of food and/or beverage.

Objects of the invention are achieved by providing a self-contained container with a cover that allows for easy transport of food and/or beverage after the food or beverage is partially consumed.

Objects of the invention are achieved by providing containers, such as disposable food containers, with a cover coupled thereto that can be suitable for a mass production and that can be readily facilitated to cover the container along with its contents.

The present invention pertains to containers for storing contents, such as food products or any other products or goods, with a cover material that is foldable and deployable. The containers of the invention comprise a base, and sidewalls extending upwardly from the base and defining an outer surface, an inner surface, and an opened periphery of the container. The containers further comprise a deployable and foldable cover material that can be disposed about at least a portion of the periphery, or at least about a portion of the outer surface of the containers. The containers of the invention are provided when the cover material is folded. Upon use, the cover material may be deployed to cover at least the opened periphery of the container.

The containers of the invention are particularly, but not necessarily, useful in restaurants. Food products may be served within the herein disclosed containers and remains of the food can be readily covered upon pulling the folded cover material over the opened periphery of the container. Hence, the herein disclosed invention provides friendly user, simple, and convenient novel containers.

According to one aspect, the present invention provides a container for storing contents, the container comprising a base, and sidewalls extending upwardly from the base and defining an outer surface, an inner surface, and an opened periphery of the container, the container further comprises a deployable and foldable cover material disposed about at least a portion of the periphery, or at least about a portion of the outer surface;

wherein the cover material is disposed about the periphery or the outer surface in a folded configuration and is deployable in an amount and shape sufficient to cover at least the opened periphery of the container.

According to an embodiment of the invention, the container is disposible.

According to an embodiment of the invention, the container is selected from the group consisting of a plate, a bowl, a tray, a cup, a vessel and a beaker.

According to a further embodiment of the invention, the cover material comprises a sheet.

According to yet a further embodiment of the invention, the sheet is manufactured from a material selected from the group consisting of a cornstarch, a polymer, a paper, a plastic, a cardboard, a foam, and a metal.

According to yet a further embodiment of the invention, the cover material is tightly folded and self-contained within the periphery or the outer surface.

According to yet a further embodiment of the invention, the container further comprises a rim surrounding at least a portion of the periphery, the rim presenting an outwardly or a downwardly faced recess, and wherein the cover material is disposed within the recess.

According to yet a further embodiment of the invention, the cover material is tightly folded and self-contained within the recess.

According to yet a further embodiment of the invention, the cover material is concealed when in the folded configuration and in an upper view of the container.

According to yet a further embodiment of the invention, the container further comprising a lid element attached to the cover material and configured to contain and/or conceal the cover material when in a folded configuration.

According to yet a further embodiment of the invention, the container further comprising a lid element attached to the cover material, the lid element is disposed above at least a portion of the rim and is configured to contain and/or conceal the cover material when in a folded configuration.

According to yet a further embodiment of the invention, the lid element is further configured to deploy said cover material over said opened periphery when pulled out by a user.

According to yet a further embodiment of the invention, the container further comprising a tab protruding from a peripheral end of the cover material, the tab is usable for accessing the cover material and deploying the cover material over the opened periphery when pulled out by a user.

According to yet a further embodiment of the invention, the tab continuously extends from the cover material.

According to yet a further embodiment of the invention, container and cover material are self-contained and sold and mass produced as a single unit.

According to yet a further embodiment of the invention, the tab is removably connected to a peripheral end of the cover material.

According to yet a further embodiment of the invention, the container comprises a periphery or sidewalls presenting a form of a polygon comprising at least three edges and the cover material is disposed along at least one edge of the polygon.

According to yet a further embodiment of the invention, the container comprises a circular periphery and/or sidewalls and the cover material surrounds at least a portion of said circular periphery and/or sidewalls.

According to yet a further embodiment of the invention, the cover material surrounds at least about 90 degrees, or at least about 180 degrees of said circular periphery or sidewalls.

The present invention further provides a method of wrapping contents within a container, comprising: providing a container as described herein; and pulling out the cover material at least until the opened periphery of the container is covered by the cover material.

According to an embodiment of the invention, pulling out is conducted via a lid element attached to the cover material.

According to yet a further embodiment of the invention, pulling out is conducted via a tab extending from a peripheral end of said cover material.

Unless otherwise defined, all technical or/and scientific terms used herein have the same meaning as commonly understood by one of ordinary skill in the art to which the invention pertains. Although methods and materials similar or equivalent to those described herein can be used in the practice or testing of embodiments of the invention, exemplary methods or/and materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

Figure 1:
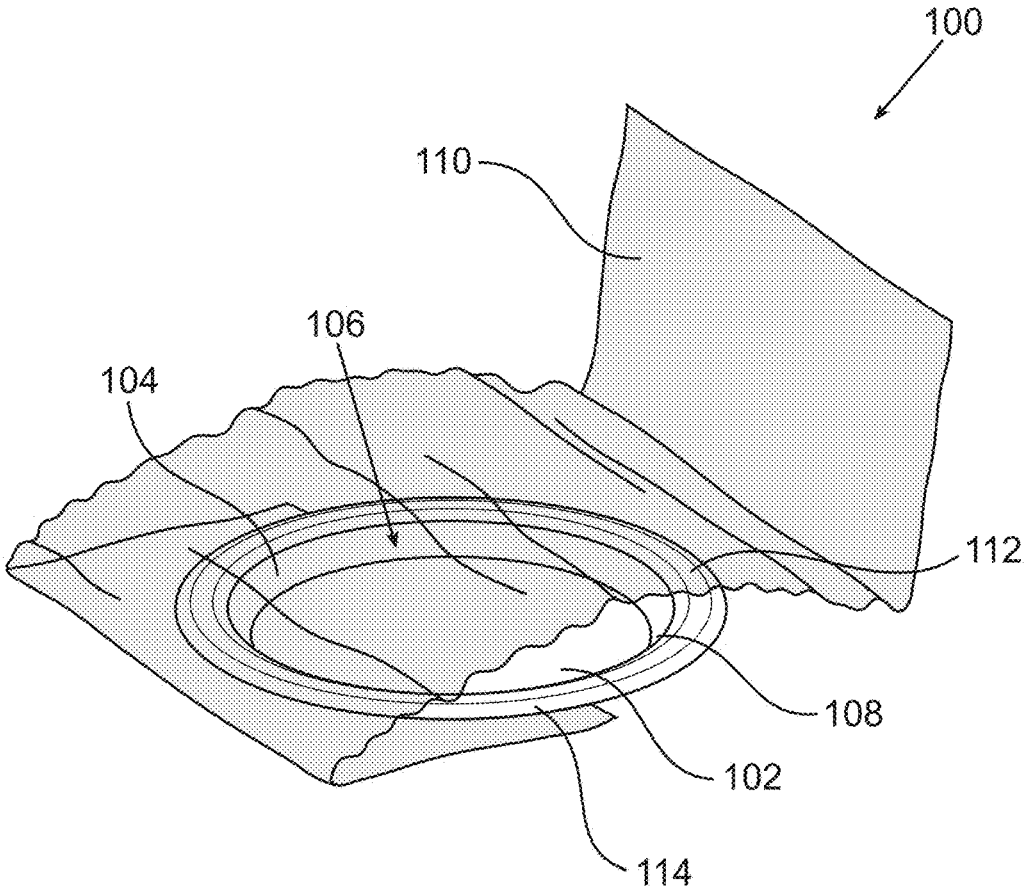
FIG. 1 is an isometric view of an exemplary container with a cover material in a deployed configuration, the cover material is shaped and sized to cover at least the opened periphery of the container.

It should be appreciated that for simplicity and clarity of illustration, elements shown in the figures have not necessarily been drawn to scale. For example, the dimensions of some of the elements are exaggerated relative to each other for clarity. Further, where considered appropriate, reference numerals have been repeated among the figures to indicate corresponding elements.

DETAILED DESCRIPTION OF THE INVENTION

It is understood that the invention is not limited to the particular methodology, protocols, and reagents, etc., described herein, as these may vary as the skilled artisan will recognize. It is also to be understood that the terminology used herein is used for the purpose of describing particular embodiments only, and is not intended to limit the scope of the invention. The following exemplary embodiments may be described in the context of exemplary embolization procedures for ease of description and understanding. However, the invention is not limited to the specifically described apparatus, devices and methods, and may be adapted to various clinical applications without departing from the overall scope of the invention. All ranges disclosed herein include the endpoints. The use of the term "or" shall be construed to mean "and/or" unless the specific context indicates otherwise.

The present invention discloses, is some embodiments thereof, containers and methods of use thereof for storing foods and other products. The containers of the invention comprise a cover material that is provided when folded and positioned within an edge or surrounds a portion of the container. The cover material may be unfolded and may be used to wrap the container and its contents.

The herein disclosed container is user friendly, cost effective, may be manufactured in a mass production and can be readily facilitated to cover the container along with its contents. The herein disclosed containers are useful, for example, in restaurants (such as fast food restaurants, etc.). Food may be served within the containers when the cover material is in a folded configuration, and leftovers may be conveniently wrapped by deploying the cover material and by covering the container and its contents.

As used herein the term "container" includes any container suitable to store contents such as food products. According to one or more embodiments, the container is disposable. According to alternative embodiments, the container is non-disposable. The container may contain a base and sidewalls extending upwardly from the base. The sidewalls define an opened periphery, an inner surface and an outer surface. The container may present any form or shape as long as contents may be stored therein. In an exemplary embodiment, the container includes a periphery and/or sidewalls presenting a form of a polygon. The polygon may comprise at least three edges. For example, the container may comprise four edges presenting the form of a rectangle. For example, the container may comprise five edges presenting the form of a pentagon. For example, the container may comprise six edges presenting the form of a hexagon. In an exemplary embodiment, the container comprises a periphery and/or sidewalls presenting the form of a circle.

According to one or more embodiments, the container presents an amorphous shape. According to some embodiments, the container may present various sizes. For example, the container may have a width and/or a length of at least about 5 centimeters (cm), at least about 10 centimeters (cm), at least about 15 centimeters (cm), or at least about 20 centimeters (cm). For example, the container may have a diameter of at least about 5 centimeters (cm), at least about 10 centimeters (cm), at least about 15 centimeters (cm), or at least about 20 centimeters (cm). The container may be selected, but is not limited to a plate, a bowl, a tray, a cup, a vessel and a beaker. The container may be circular. The container may be non-circular. The container may be manufactured from any material. Non-limiting examples include, a polymeric material or a polymer, a plastic, a foam (e.g., polystyrene), a glass, a wood, a carton, a cornstarch, and a metal (such as aluminum).

The container may be manufactured from a heat stable material, or a plastic resistance to heat, consequently affording heating the container. According to some embodiments, the container may be transparent, or partially transparent.

According to one or more embodiments, the container is flexible. According to one or more embodiments, the container is extendible. According to one or more embodiments, the container is resilient. According to one or more embodiments, the container comprises a sealing element coupled to the cover material, thereby affording sealing the container with its contents. According to one or more embodiments, the sealing element includes various types of adhesive devices to seal the cover material to the container when deployed.

As used herein the term "cover material" refers to any material that can function to cover a container according to the herein described embodiments. According to some embodiments, the cover material comprises a sheet. According to some embodiments, the cover material presents the form of a sheet. According to one or more embodiments, the term sheet is interchangeable with the term film, and/or layer. The cover material may present many forms or shapes. According to one or more embodiments, the shape of the cover material depends on the shape of the container. According to one or more embodiments, the cover material presents a circular shape (e.g., an ellipse, and a circle). According to one or more embodiments, the cover material presents a shape of a polygon (e.g., a triangle, a rectangle, a pentagon, etc.). According to one or more embodiments, the cover material presents an amorphous shape. According to some embodiments, the cover material may present various sizes. According to some embodiments, the cover material may have a size that vary according to the size if the container, and/or the periphery of the container. According to an exemplary embodiment, the cover material may have dimensions (diameter, length, and/or width) that are larger than the dimensions of the opened periphery, and/or entire area of the container. For example, the cover material may have a width and/or a length, and/or a diameter that is larger than corresponding dimensions of the opened periphery of the container by at least about 1.1, 1.2, 1.4, 1.6, 1.8, 2, 2.2, 2.4, 2.6, 2.8, or 3. The cover material may have a width and/or a length of at least about 5 centimeters (cm), at least about 10 centimeters (cm), at least about 15 centimeters (cm), at least about 20 centimeters (cm), at least about 25 centimeters (cm), at least about 30 centimeters (cm), or at least about 35 centimeters (cm). For example, the cover material may have a diameter of at least about 5 centimeters (cm), at least about 10 centimeters (cm), at least about 15 centimeters (cm), at least about 20 centimeters (cm), at least about 25 centimeters (cm), at least about 30 centimeters (cm), or at least about 35 centimeters (cm).

According to one or more embodiments, the cover material may be manufactured form any suitable material, as long as the cover material maintains its foldable and deployable characteristics. For example, the cover material may be manufactured from a material selected from the group consisting of a cornstarch, a polymeric material or a polymer, a paper, a wood, a plastic, a foam (e.g., polystyrene) a cardboard and a metal (e.g., an aluminum). The cover material may be manufactured from a heat stable material, or a plastic resistance to heat, consequently affording heating the container along with the cover material. The cover material may be, according to one or more embodiments, removably connected to the container. The cover material may be, according to one or more embodiments, not connected to the container. The cover material may be, according to one or more embodiments, affixed to the container in a non-removable manner. The cover material and container may be, according to one or more embodiments, manufactured from the same material, presenting a single integral container.

According to one or more embodiments, the cover element includes saran wrap or other such plastic materials.

According to some embodiments, the cover material may be transparent, or partially transparent, or non-transparent.

According to one or more embodiments, the cover material is flexible. According to one or more embodiments, the cover material is extendible. According to one or more embodiments, the cover material is resilient. According to one or more embodiments, the cover material is stackable. According to one or more embodiments, the cover material has the capacity to seal the opened periphery of the container. According to one or more embodiments, the cover material is stackable when disposed within the container.

According to some embodiments, the cover material is shaped and sized to cover at least the opened periphery of the container such that the contents included within the container are fully covered. According to some embodiments, the cover material is shaped and sized to cover the opened periphery, and/or the one or more sidewalls of the container, and/or the bottom of the container.

According to one or more embodiments, the herein disclosed cover material is transferable from a folded configuration to an unfolded or deployed configuration. According to one or more embodiments, the herein disclosed cover material is transferable from an unfolded or deployed configuration to a folded configuration.

According to one or more embodiments, the herein disclosed containers comprise a cover material which may be positioned such that the cover material is concealed and revealed upon use for wrapping the container and its contents.

According to one or more embodiments, the cover material is partially concealed such that portions thereof are concealed and other portions are visible when in a folded and/or deployed configuration.

According to one or more embodiments, the cover material is substantially concealed and merely reveals a tab or a lid element for aiding in deploying the cover material for use in wrapping the container and its contents.

The term "amount and shape" is interchangeable with the term "shape and size". The term "amount" means quantity or dimensions and the term "shape" means form. The term "shape" may be selected, without limitation from the group comprising a circle (e.g., an ellipse), an amorphous shape, and a polygon.

As used herein the term "foldable" refers to the capacity of the cover material to fold and/or to contract, and/or to be wrapped, and to be stacked, and/or to be loaded.

As used herein the term "folded configuration" refers to the position of the cover material when it is folded, and/or contracted, and/or wrapped, and/or stacked, and/or loaded. For example, the cover material may be folded to present two or more folds. For example, three or more folds, four or more folds, five or more folds, six or more folds, seven or more folds, eight or more folds, nine or more folds, or ten or more folds. Any type of fold is herein contemplated. According to one or more embodiments, the cover material presents an accordion-type fold. According to one or more embodiments, the cover material is tightly folded within the container. As used herein the term "tightly folded" refers to the cover material being compressed when folded.

As used herein the term "self-contained" means that the cover material has the capacity to present its folded configuration and is maintained as such without any element or article used to keep the cover material in the folded configuration.

As used herein the term "deployable" refers to the capacity of the cover material to deploy and/or to extend.

As used herein the term "deployed configuration" is interchangeable with the term "unfolded configuration" and refers to the position of the cover material when it is unfolded or deployed.

Referring now to the drawings, FIG. 1 depicts an exemplary container 100 of the invention. Container 100 comprises a base 102, and sidewall 104 extending upwardly from base 102. Sidewall 104 defines an outer surface 105 (shown in FIGS. 10 and 11), an inner surface 106, and an opened periphery 108. Inner surface 106 defines an inner lumen sized and shaped for storing food products. Container 100 presents an opened circular periphery 108. More particularly, the herein exemplified container 100 possesses the form of a plate.

Container 100 further comprises a deployable and foldable cover material 110. Cover material 110 is transferable from a folded or stacked configuration (shown for example at FIG. 11) to a deployed configuration. FIG. 1 presents cover material 110 when in a deployed configuration and when provided in an amount and shape sufficient to cover at least opened periphery 108 of container 100. Cover material 110 may be provided in an amount and shape sufficient to cover at least a portion of outer surface 105 of container 100 and/or at least a portion of bottom surface 111 (shown for example at FIG. 11) of container 100. According to one or more embodiments, cover material 110 may be provided in an amount and shape sufficient to cover opened periphery 108 and/or sidewalls 104, and/or bottom surface 111 of container 100. According to one or more embodiments, cover material 110 may be provided in an amount and shape sufficient to cover container 100 entirely.

According to one or more embodiments, container 100 further comprises a rim 112 surrounding periphery 108. It is to be noted that rim 112 of container 100 surrounds the entire periphery 108, but rim 112 may surround a portion of, or at least a portion of periphery 108. For example, rim 112 may surround at least 45 degrees of periphery 108. For example, rim 112 may surround at least 90 degrees, at least 120 degrees, at least 150 degrees, at least 180 degrees, at least 220 degrees, at least 250 degrees, at least 280 degrees, at least 300 degrees, or at least 330 degrees of periphery 108. Rim 112 of container 100 presents a downwardly faced recess 114. Other shapes or forms of rim 112 are contemplated. For example, rim 112 may alternatively present an outwardly faced recess. Cover material 110 may be disposed in various positions within container 100. For example, cover material 110 may be disposed about at least a portion of periphery 108. Alternatively, or additionally, cover material 110 may be disposed about at least a portion of outer surface 105. Alternatively, or additionally, cover material 110 may be disposed about at least a portion of inner surface 106. Alternatively, or additionally, cover material 110 may be disposed about at least a portion of bottom surface 111. Alternatively, or additionally, cover material 110 may be disposed within recess 114.

It is to be understood that by the term "disposed" it is meant to include that the cover material may be placed, positioned, directly connected, indirectly connected, coupled, or conjugated to container 100.

According to one or more embodiments, cover material 110 may be disposed about at least a portion of periphery 108, rim 112 and/or recess 114. For example, container 100 comprises a circular periphery 108, rim 112 and/or recess 114 and the cover material 110 surrounds at least a portion of circular periphery 108, rim 112 and/or recess 114. According to some embodiments, cover material 110 surrounds at least about 20 degrees of periphery 108, rim 112 and/or recess 114. For example, at least about 25 degrees, at least about 30 degrees, at least about 40 degrees, at least about 50 degrees, at least about 60 degrees, at least about 70 degrees, at least about 80 degrees, at least about 90 degrees, at least about 100 degrees, at least about 120 degrees, at least about 140 degrees, at least about 160 degrees, at least about 180 degrees, at least about 200 degrees, at least about 220 degrees, at least about 240 degrees, at least about 260 degrees, at least about 280 degrees, at least about 300 degrees, at least about 320 degrees, or at least about 340 degrees of periphery 108, rim 112 and/or recess 114. According to an exemplary embodiment, cover material 110 surrounds about 90 degrees of periphery 108, rim 112 and/or recess 114. According to another exemplary embodiment, cover material 110 surrounds about 180 degrees of periphery 108, rim 112 and/or recess 114. According to yet another exemplary embodiment, cover material 110 surrounds about 360 degrees of periphery 108, rim 112 and/or recess 114.

Figure 2:
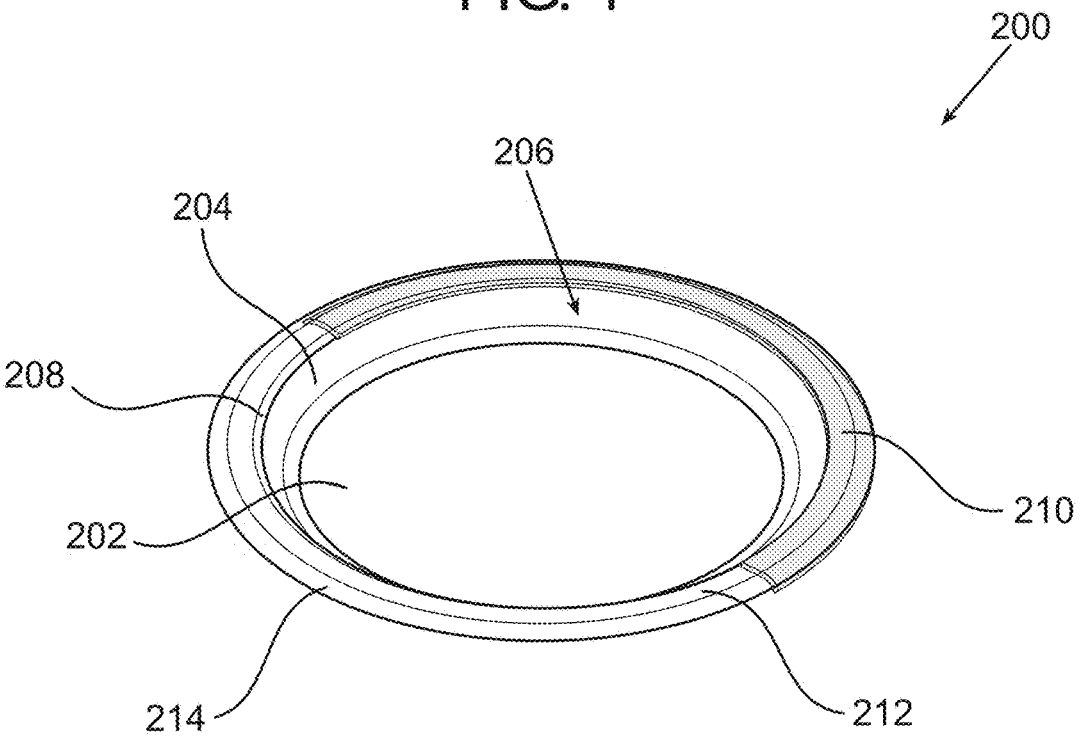
FIG. 2 is an isometric view of a further exemplary container with a cover material, the cover material is folded and surrounds about 180 degrees of a rim of the container.

Reference is now made to FIG. 2 presenting container 200 according to some embodiments of the invention. Similarly to container 100, container 200 comprises a base 202, and sidewalls 204 extending upwardly from base 202. Sidewalls 204 define an outer surface (not shown), an inner surface 206, and an opened periphery 208. Further similarly to container 100, container 200 comprises a rim 212 and a downwardly faced recess 214. Container 200 further comprises a deployable and foldable cover material 210. In container 200, cover material 210 surrounds about 180 degrees of periphery 208, rim 212 and/or recess 214. In an exemplary embodiment, cover material 210 is disposed within downwardly faced recess 214. In yet a further exemplary embodiment, cover material 210 is disposed above downwardly faced recess 214.

Figure 3:
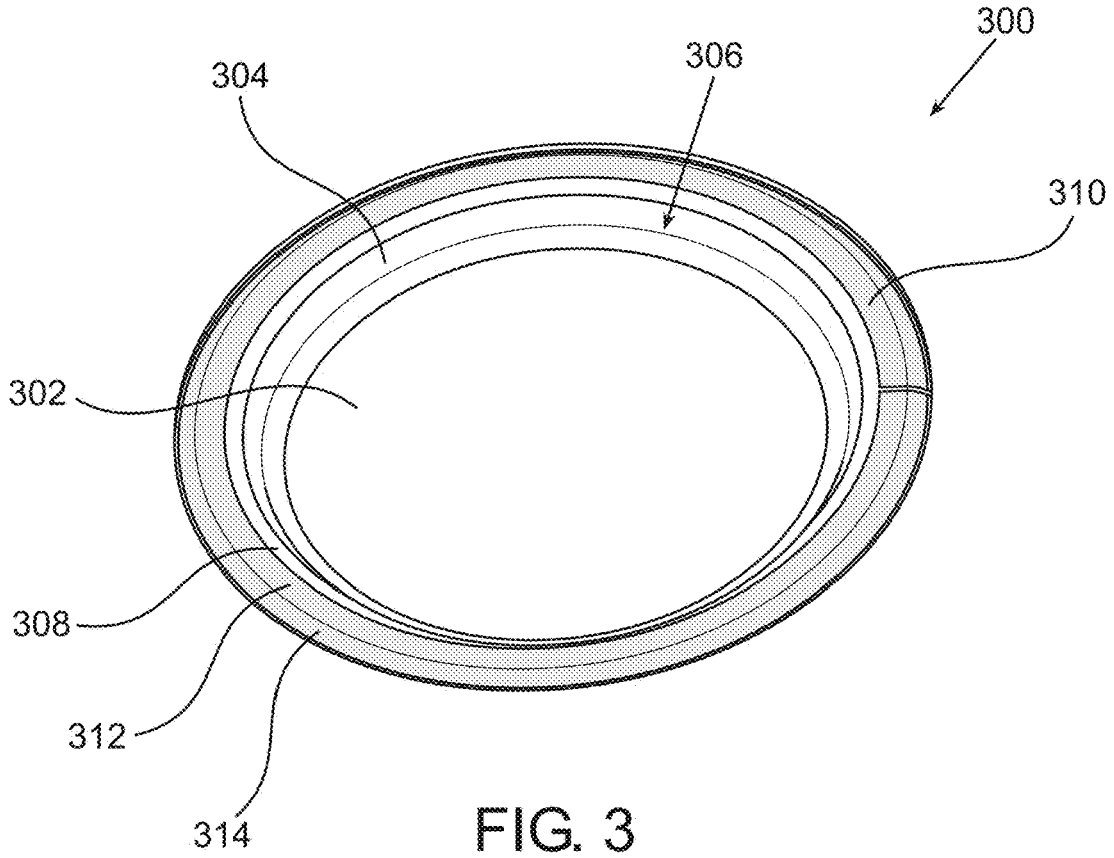
FIG. 3 is an isometric bottom view of yet a further exemplary container with a cover material, the cover material is folded and surrounds about 360 degrees of a rim or downwardly faced recess of the container.

Reference is now made to FIG. 3 demonstrating a further exemplary container of the invention. Container 300 is similar to container 100, and container 200, in that it comprises a base 302, and sidewalls 304 extending upwardly from base 302. Sidewalls 304 define an outer surface 305 (shown in FIG. 6), an inner surface 306, and an opened periphery 308. Container 300 further comprises a deployable and foldable cover material 310. Cover material 310 is shown in FIG. 3 when in a folded configuration. Further similarly to containers 100, and 200, container 300 comprises a rim 312 and a downwardly faced recess 314. In container 300, cover material 310 surrounds at least about 300 degrees, at least about 310 degrees, at least about 320 degrees, at least about 330 degrees, at least about 340 degrees, or at least about 350 degrees of periphery 308, rim 312 and/or recess 314. In container 300, cover material 310 surrounds about 360 degrees of periphery 308, rim 312 and/or recess 314. In an exemplary embodiment, cover material 310 in disposed within downwardly faced recess 314. In accordance with this embodiment, cover material 310 may be substantially concealed or entirely concealed within recess 314.

Figure 4:
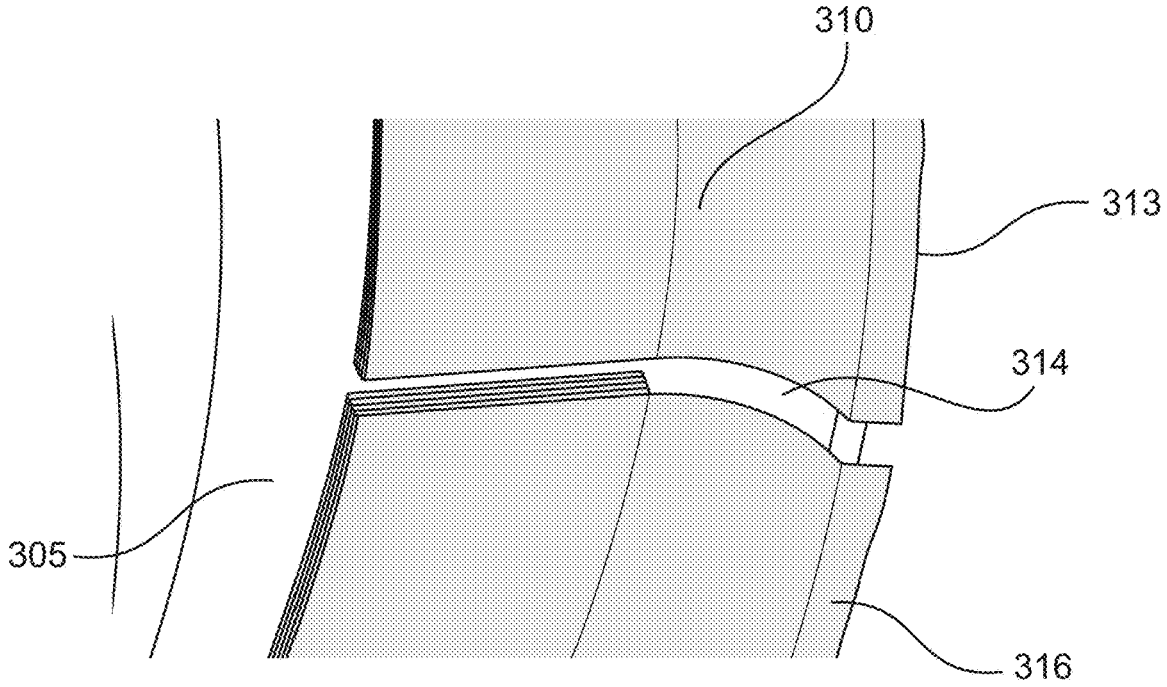
FIG. 4 is a magnified isometric bottom view showing a bottom side portion of a container with a cover material, the cover material is folded and surrounds about 360 degrees of a rim or downwardly faced recess of the container.

Referring now to FIG. 4, a magnified isometric view of a portion of outer surface 305 of container 300 is shown. Cover material 310 is disposed in a folded configuration within downwardly faced recess 314. Cover material 310 may present a substantially annular form comprising an inner periphery end 311 (shown in FIG. 6 and an outer periphery end 313. Cover material 310 may comprise a tab 316 outwardly extending and protruding from periphery 308, rim 312 and/or recess 314. Cover material 310 may comprise a tab 316 provided as an outwardly protruding fold of outer periphery end 313. Alternatively, or additionally, cover material 310 may comprise a tab 316 extending and protruding from outer periphery end 313 of cover material 310. Tab 316 is usable for accessing cover material 310. Tab 316 is usable for deploying cover material 310 over opened periphery 308 when pulled out by a user. According to one or more embodiments, in a top view of container 300, cover material 310 is concealed within periphery 308, rim 312 and/or recess 314, when in a folded configuration. According to one or more embodiments, in a top view of container 300, cover material 310 is concealed within periphery 308, rim 312 and/or recess 314, when in a folded configuration, except for tab 316 that outwardly protrudes from periphery 308, rim 312 and/or recess 314.

Figure 5:
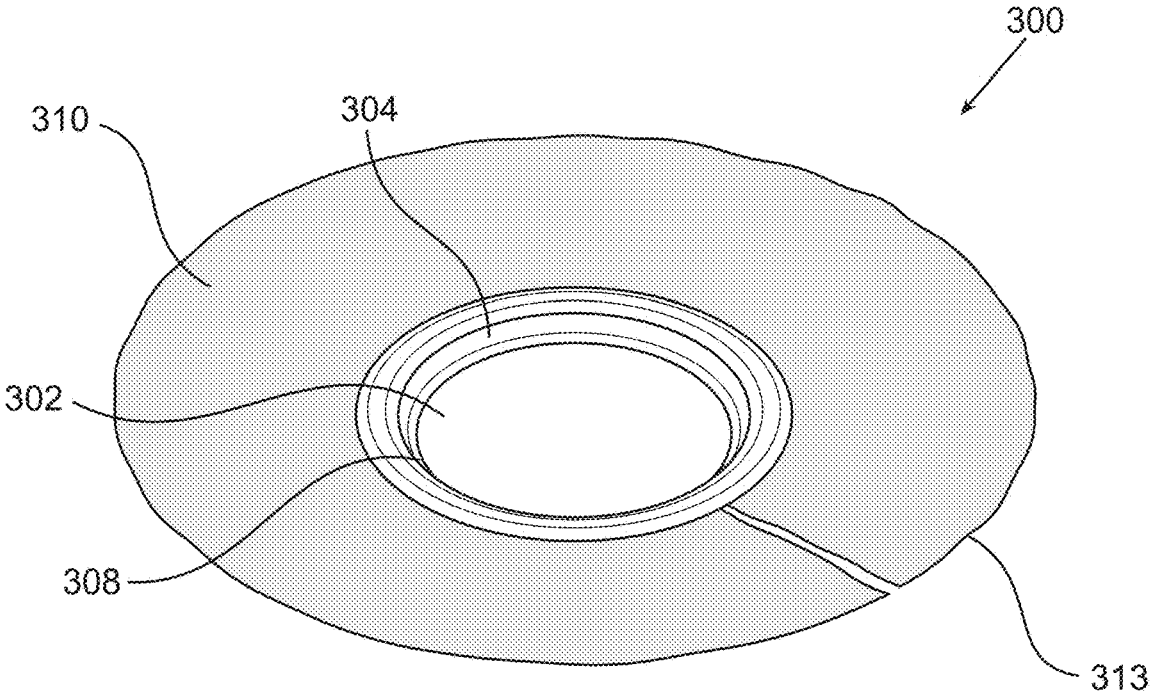
FIG. 5 is an isometric top view of yet a further exemplary container with a cover material, the cover material is deployed and surrounds about 360 degrees of a rim and/or periphery of the container.
Figure 6:
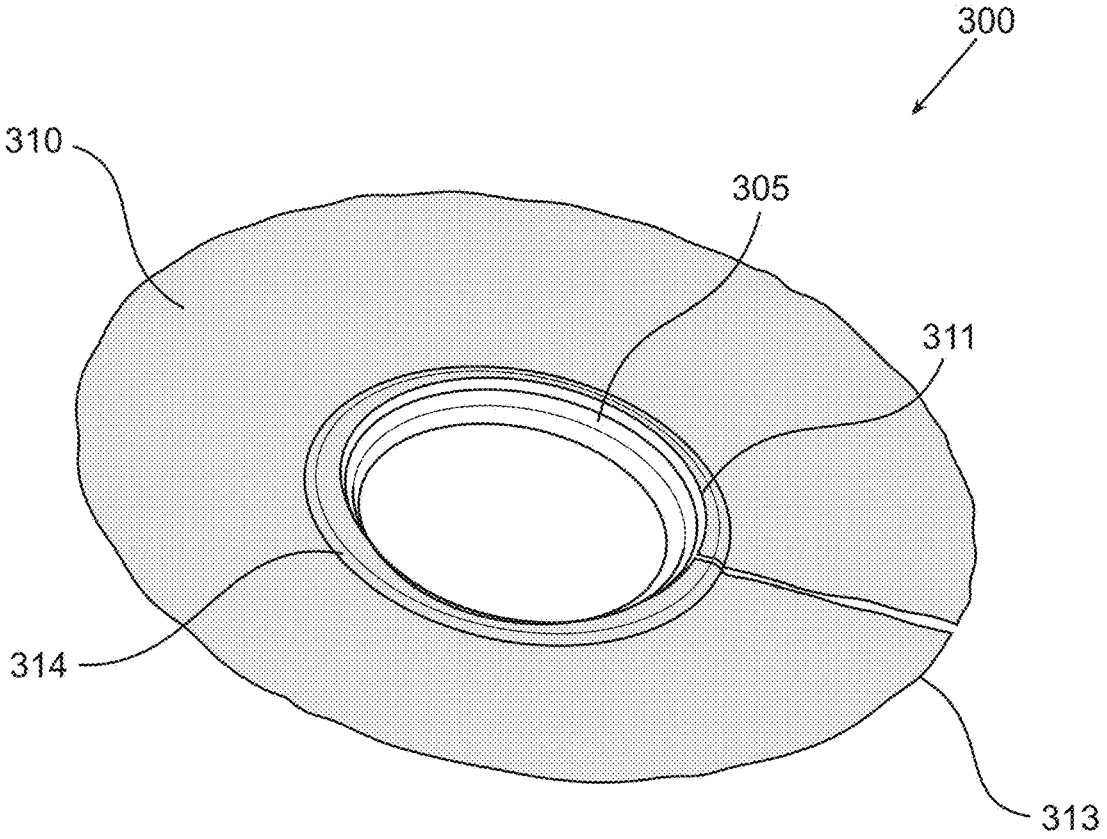
FIG. 6 is an isometric bottom view of a container with a cover material, the cover material is deployed and surrounds about 360 degrees of a rim and/or periphery of the container.

Reference is now made to FIGS. 5 and 6 presenting a top view (FIG. 5) and a bottom view (FIG. 6) of container 300, according to one or more embodiments of the invention. The figures present an exemplary embodiment of the invention, wherein cover material 310 is disposed within recess 314 and cover material 310 surrounds at least about 340, or about 360 degrees of periphery 308. Cover material 310 is shown in a deployed configuration. Cover material 310 presents an opened annular shape, but a closed annular shape for cover material 310 is also contemplated. Cover material 310 is coupled to container 300 via an attachment (shown in FIG. 10), wherein inner periphery end 311 is being adhered to downwardly faced recess 314.

Figure 7:
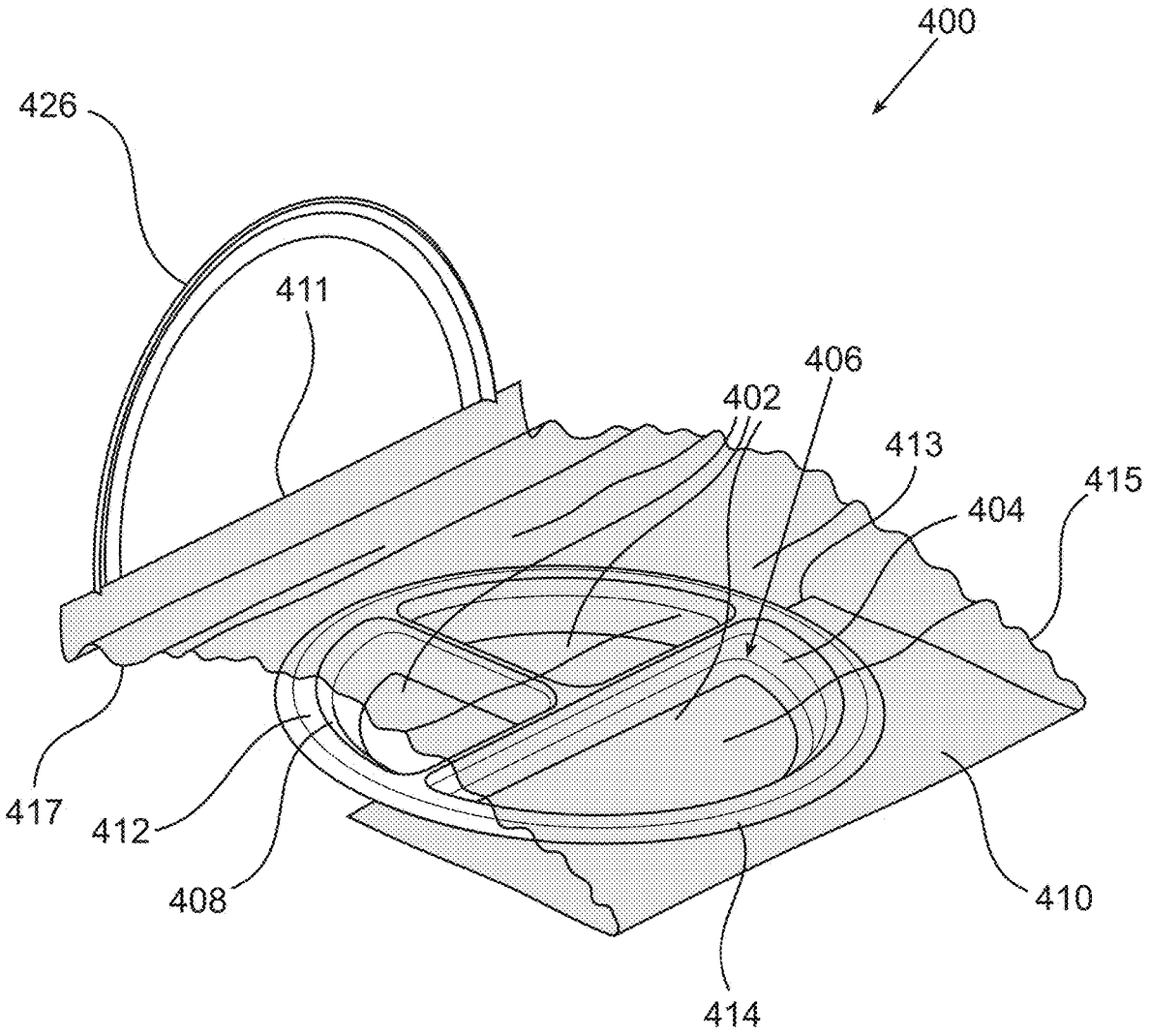
FIG. 7 is an isometric view of yet a further exemplary container with a cover material attached to a lid element, the cover material is in a deployed configuration and is shaped and sized to cover at least the opened periphery of the container.

Reference is now made to FIG. 7 presenting container 400 according to some embodiments of the invention. Similarly to containers 100, 200, and 300, container 400 comprises a base 402, and sidewalls 404 extending upwardly from base 402. Sidewalls 404 define an outer surface (not shown), an inner surface 406, and an opened periphery 408. Further similarly to containers 100, 200 and 300, container 400 comprises a rim 412 and a downwardly faced recess 414. Container 400 further comprises a deployable and foldable cover material 410. In container 400, cover material 410 may surround at least about 90 degrees or at least about 180 degrees of periphery 408, rim 412 and/or recess 414. Container 400 may comprise a lid element 426 configured to deploy cover material 410 over opened periphery 408 when pulled out by a user. Cover material 410 may be disposed above downwardly faced recess 414. In accordance with this embodiment, cover material 410 is disposed between rim 412 and lid element 426. Further in accordance with this embodiment, cover material 410 may be concealed when positioned within lid element 426 and rim 412. Cover material 410 may present the form of a rectangular comprising a peripheral end with a first, a second, a third and a fourth edge, designated herein as first periphery end 411, second periphery end 413, third periphery end 415, and fourth periphery end 417, respectively. Lid element 426 may be coupled to first periphery end 411 of cover material 410 Lid element 426 may be coupled to two, or more, opposing ends of first periphery end 411 of cover material 410. In one or more embodiments, lid element 426 may be coupled to one or more, three or more, or four or more positions within a periphery end of cover material 410.

Alternatively, or additionally, lid element 426 may be coupled to periphery 408 and/or to rim 412, and/or to recess 414. Lid element 426 a be coupled directly and connected to rim 412. Lid element 426 may be coupled directly and connected to periphery 408. Alternatively, lid element 426 may be coupled to rim 412 and/or periphery 408 indirectly via a further attachment element such as an adhesive and/or using welding and/or melting techniques to join lid element 426 to rim 412 or to periphery 408. In certain embodiments, lid element 426, rim 412 and/or periphery 408 are all manufactured as one piece. Lid element 426 may be shaped and sized to conform to periphery 408, rim 412 and/or recess 414. Accordingly, lid element 426 may be placed on top or underneath periphery 408, rim 412 and/or recess 414. According to one or more embodiments, lid element 426 is configured to contain cover material 410 when provided in a folded configuration. According to one or more embodiments, lid element 426 is configured to conceal cover material 410 when provided in a folded configuration. Accordingly, cover material 410 may be disposed between lid element 426 and rim 412 of container 410.

Figure 8:
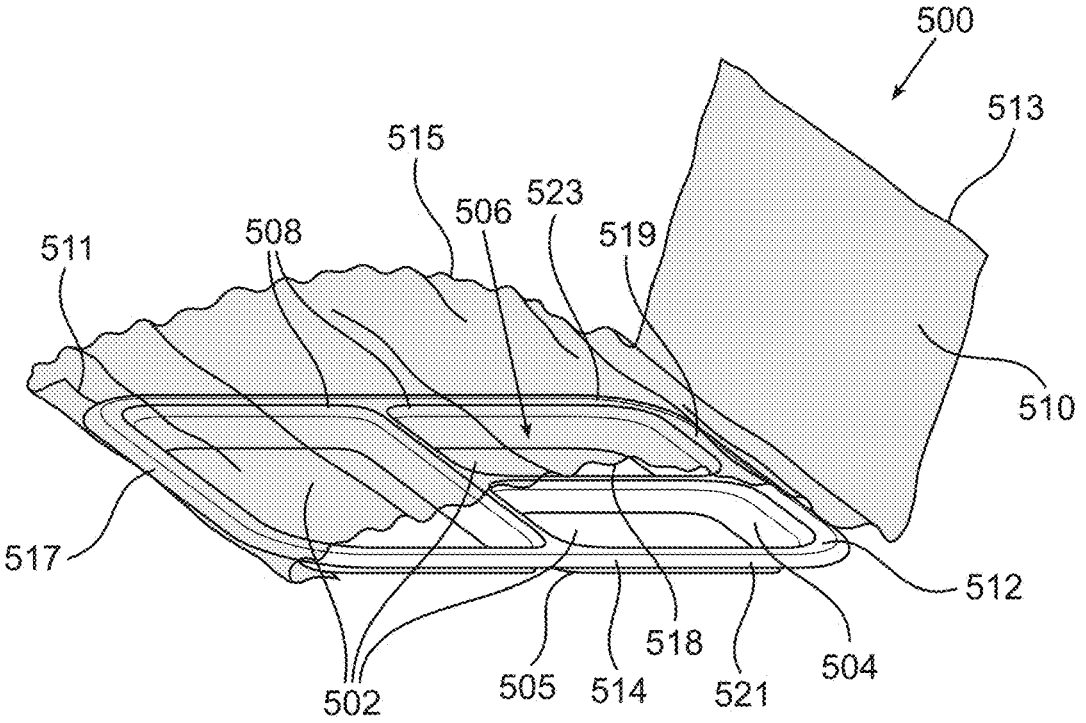
FIG. 8 is an isometric view of yet a further exemplary container presenting the form of a rectangular, the container comprises a cover material disposed about a first edge of the container, the cover material is in a deployed configuration and is shaped and sized to cover at least the opened periphery of the container.

Reference is now made to FIG. 8 that presents container 500 according to exemplary embodiments of the invention. Similarly to containers 100, 200 300, and 400, container 500 comprises a base 502, and sidewalls 504 extending upwardly from base 502. Sidewalls 504 define an outer surface 505, an inner surface 506, and an opened periphery 508. Container 500 presents a form of a rectangular comprising container first edge 517, container second edge 519, container third edge 521, and container fourth edge 523. Container 500 comprises a rim 512 extending outwardly from periphery 508 of container first edge 517, container second edge 519, container third edge 521, and/or container fourth edge 523. Container 500 may comprise a downwardly faced recess 514 within rim 512 of container first edge 517, container second edge 519, container third edge 521, and/or container fourth edge 523.

Container 500 further comprises a deployable and foldable cover material 510. Cover material 510 may present a form of a rectangular comprising a first, a second, a third and a fourth edge, designated herein as first periphery end 511, second periphery end 513, third periphery end 515, and fourth periphery end 518, respectively. Cover material 510 is shown in FIG. 8 when in a deployed configuration. Cover material 510 may, when provided in a folded configuration, be disposed within periphery 508 of container first edge 517, container second edge 519, container third edge 521, and/or container fourth edge 523. Cover material 510 may, when provided in a folded configuration, be disposed within rim 512 of container first edge 517, container second edge 519, container third edge 521, and/or container fourth edge 523. Cover material 510 may, when provided in a folded configuration, be disposed within recess 514 of container first edge 517, container second edge 519, container third edge 521, and/or container fourth edge 523. In an exemplary embodiment, and as shown in FIG. 8, cover material first periphery end 511 is disposed (e.g., adhered to) within recess 514 of container first edge 517.

Figure 9:
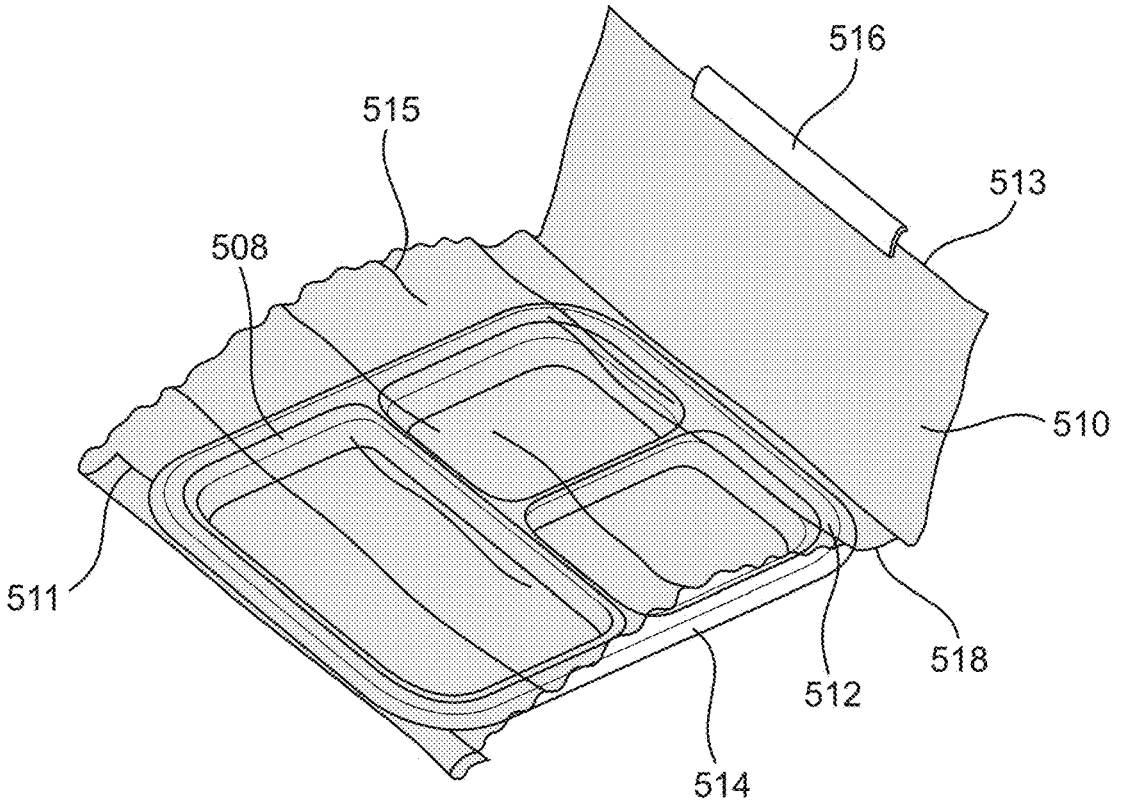
FIG. 9 is an isometric view of a container presenting the form of a rectangular, the container comprises a cover material disposed about a first edge of the container, the cover material comprises a tab configured to deployed the cover material when pulled out by a user, the cover material is shaped and sized to cover at least the opened periphery of the container.

Referring now to FIG. 9, container 500 is shown when provided with a tab 516 extending and protruding from a peripheral end of cover material 510. Tab 516 extends and protrudes from second periphery end 513 of cover material 510. Tab 516 is usable for accessing cover material 510 and deploying cover material 510 over the opened periphery 508 when pulled out by a user. Tab 516 may continuously extend from a peripheral end 511, 513, 515, and/or 518 of cover material 510. Tab 516 may be removably connected to a peripheral end of the cover material. Tab 516 may outwardly protrude from periphery 508, rim 512 and/or recess 514. According to one or more embodiments, in a top view of container 500, cover material 510 is concealed within periphery 508, rim 512 and/or recess 514, when in a folded configuration. According to one or more embodiments, in a top view of container 500, cover material 510 is concealed within periphery 508, rim 512 and/or recess 514, when in a folded configuration, except for tab 516 that outwardly protrudes from periphery 508, rim 512 and/or recess 514.

Figure 10:
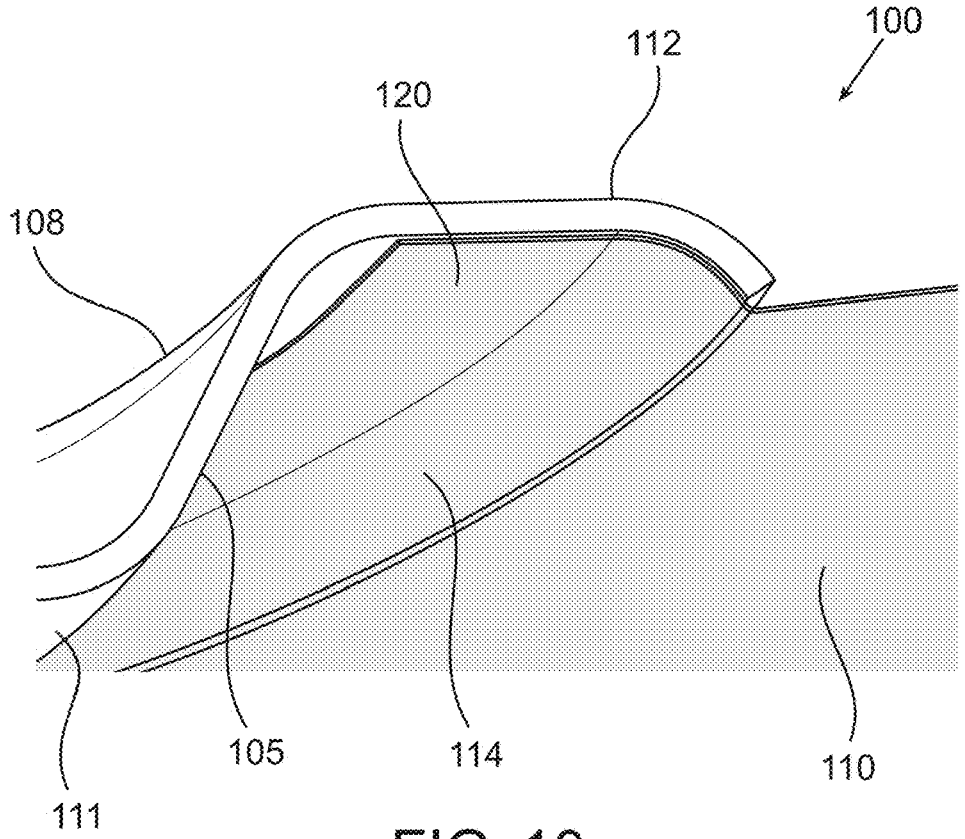
FIG. 10 is a magnified isometric cross section view showing a bottom side portion of a container with a cover material, wherein a peripheral end of the cover material is disposed within a downwardly faces recess and is adhered thereto.

Reference is now made to FIG. 10, that presents adhesion via attachment 120 of cover material 110 to recess 114. The description below refers to container 100 for exemplary reasons only, however, the description of this FIG. equally applies for any of the containers described herein. Attachment 120 of cover material 110 to container may be made by any suitable material or method. For example, adherence using a suitable glue is contemplated. The cover material 110 may be welded to container 100. Alternatively, cover material 110 may be coupled to periphery 108, rim 112, recess 114, or to outer surface 105 by staples or by any other means, such as adhesives, melting a first section of the cover material 110, or other such fastening or joining means known in the art.

Figure 11:
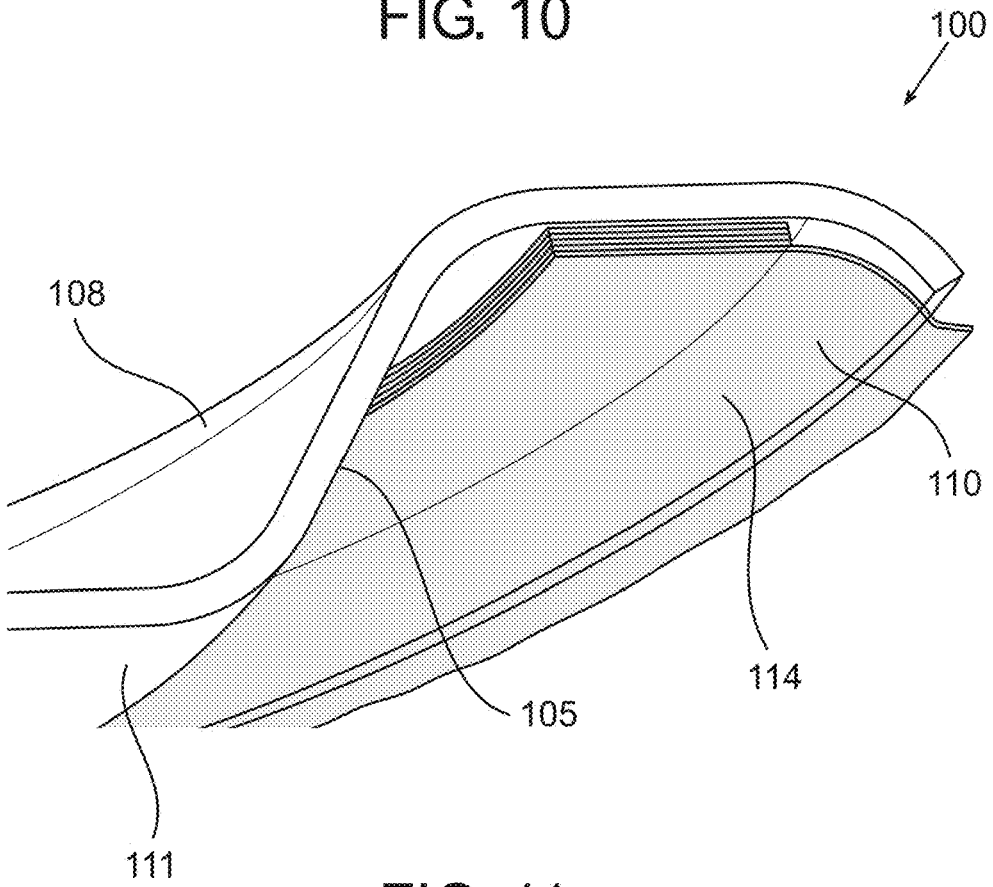
FIG. 11 is a magnified isometric bottom view showing a bottom side portion of a container with a cover material when folded and disposed within a downwardly faces recess.

Referring to FIG. 11, that presents cover material 110 that is folded within recess 114 of container 100. The description below refers to container 100 for exemplary reasons only, however, the description of this FIG. equally applies for any of the containers described herein. According to one or more embodiments, cover material 110 is folded and self-contained within recess 114. Cover material 110 may be folded within recess 114 and present a couple of folds. For example, 2 or more folds, 3 or more folds, 4 or more, or 5 or more folds. Any suitable fold that affords unfolding of cover material 110 is contemplated. For example, cover material is folded in an accordion-type fold. According to another embodiment, cover material may be un-folded.

The present invention further provides a method of wrapping contents within a container, the method comprising: providing a container as herein described; and pulling out the cover material; at least until an opened periphery of the container is covered by the cover material.

The present invention further provides a method of storing contents within a container, the method comprising: providing a container as herein described; and pulling out the cover material at least until an opened periphery of the container is covered by the cover material.

As used herein the term "pulling out" means pulling, deploying, extending, taking out, and/or attracting the cover material at least until an opened periphery of the container is covered by the cover material. In some embodiments, pulling out is conducted via a lid element attached to the cover material. In some embodiments, pulling out is conducted via a tab extending from a peripheral end of the cover material. In some embodiments, pulling out is conducted by pulling a peripheral end of the cover material. Pulling out affords deploying cover material over the opened periphery of the container and wrapping the container with the cover material. The method further comprises a step of sealing the container with the cover material by tightening the cover material around the container.

Each of the following terms: 'includes', 'including', 'has', 'having', 'comprises', and 'comprising', and, their linguistic/grammatical variants, derivatives, or/and conjugates, as used herein, means 'including, but not limited to', and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase 'consisting essentially of'.

Each of the phrases 'consisting of' and 'consists of', as used herein, means 'including and limited to'.

The term 'method', as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Throughout this disclosure, a numerical value of a parameter, feature, characteristic, object, or dimension, may be stated or described in terms of a numerical range format. Such a numerical range format, as used herein, illustrates implementation of some exemplary embodiments of the invention, and does not inflexibly limit the scope of the exemplary embodiments of the invention. Accordingly, a stated or described numerical range also refers to, and encompasses, all possible sub-ranges and individual numerical values (where a numerical value may be expressed as a whole, integral, or fractional number) within that stated or described numerical range. For example, a stated or described numerical range 'from 1 to 6' also refers to, and encompasses, all possible sub-ranges, such as 'from 1 to 3', 'from 1 to 4', 'from 1 to 5', 'from 2 to 4', 'from 2 to 6', 'from 3 to 6', etc., and individual numerical values, such as '1', '1.3', '2', '2.8', '3', '3.5', '4', '4.6', '5', '5.2', and '6', within the stated or described numerical range of 'from 1 to 6'. This applies regardless of the numerical breadth, extent, or size, of the stated or described numerical range.

Moreover, for stating or describing a numerical range, the phrase 'in a range of between about a first numerical value and about a second numerical value', is considered equivalent to, and meaning the same as, the phrase 'in a range of from about a first numerical value to about a second numerical value', and, thus, the two equivalently meaning phrases may be used interchangeably. For example, for stating or describing the numerical range of room temperature, the phrase 'room temperature refers to a temperature in a range of between about 20° C. and about 25° C.', and is considered equivalent to, and meaning the same as, the phrase 'room temperature refers to a temperature in a range of from about 20° C. to about 25° C.'.

The term 'about', is some embodiments, refers to ±30% of the stated numerical value. In further embodiments, the term refers to ±20% of the stated numerical value. In yet further embodiments, the term refers to ±10% of the stated numerical value.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub combination in the context or format of a single embodiment, may also be illustratively described and presented in the context or format of a plurality of separate embodiments.

Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

The invention claimed is:

1. A food container, comprising:

a base, and a sidewall extending upwardly from said base and defining an outer surface, an inner surface, and an opened periphery of said container, the container further comprises a deployable and foldable cover material disposed about at least a portion of said periphery, or at least about a portion of said outer surface;

wherein the cover material is disposed about said periphery or said outer surface in a folded configuration and is deployable in an amount and shape sufficient to cover at least said opened periphery of the container in a deployed configuration.

2. The container of claim 1, wherein the container is selected from the group consisting of a plate, a bowl, a tray, a cup, a vessel and a beaker.

3. The container of claim 1, wherein the cover material comprises a sheet.

4. The container of claim 3, wherein the sheet is manufactured from a material selected from the group consisting of a cornstarch, a polymer, a paper, a plastic, a cardboard, a foam, and a metal.

5. The container of claim 1, wherein the cover material is tightly folded and self-contained within said periphery or said outer surface.

6. The container of claim 1, wherein the cover material is concealed when in the folded configuration and in an upper view of the container.

7. The container of claim 1, further comprising a lid element attached to said cover material and configured to contain and/or conceal said cover material when in a folded configuration.

8. The container of claim 7, wherein said lid element is further configured to deploy said cover material over said opened periphery when pulled out by a user.

9. The container of claim 1, further comprising a tab protruding from a peripheral end of said cover material, said tab is usable for accessing said cover material and deploying said cover material over said opened periphery when pulled out by a user.

10. The container of claim 9, wherein said tab continuously extends from said cover material and is removably connected to a peripheral end of said cover material.

11. The container of claim 1, wherein said container comprises a periphery or sidewalls presenting a form of a polygon comprising at least three edges and the cover material is disposed along at least one edge of said polygon.

12. The container of claim 1, wherein the cover material surrounds at least a portion of said circular periphery and/or sidewall.

13. The container of claim 12, wherein said cover material surrounds at least about 90 degrees, or at least about 180 degrees of said circular periphery or sidewall.

14. A method of wrapping contents within a food container, the method comprising the steps of:

providing a food container according to claim 1; and pulling out said cover material at least until said opened periphery of the container is covered by said cover material.

15. The method of claim 14, wherein said pulling out is conducted via a lid element attached to said cover material.

16. The method according to claim 14, wherein said pulling out is conducted via a tab extending from a peripheral end of said cover material.

17. The container of claim 1, wherein the container is disposable.

18. A container, the container comprising:

a base, and a sidewall extending upwardly from said base and defining an outer surface, an inner surface, and an opened periphery of said container, the container further comprises a deployable and foldable cover material disposed about at least a portion of said periphery, or at least about a portion of said outer surface;

wherein the cover material is disposed about said periphery or said outer surface in a folded configuration and is deployable in an amount and shape sufficient to cover at least said opened periphery of the container; and wherein said container further comprises a rim surrounding at least a portion of said periphery, the rim presenting an outwardly or a downwardly faced recess, and wherein said cover material is disposed within said recess.

19. The container of claim 18, wherein the cover material is tightly folded and self-contained within said recess.

20. The container of claim 18, further comprising a lid element attached to said cover material, said lid element is disposed above at least a portion of said rim and is configured to contain and/or conceal said cover material when in a folded configuration.

* * * * *